US012338595B2

(12) United States Patent
Eide et al.

(10) Patent No.: US 12,338,595 B2
(45) **Date of Patent: *Jun. 24, 2025**

(54) FOUNDATION MODULARIZATION

(71) Applicant: EQUINOR ENERGY AS, Stavanger (NO)

(72) Inventors: Asle Eide, Sandnes (NO); Morten Sæther, Lillestrøm (NO); Harald Sigurd Nesse, Sandnes (NO); Lorents Reinås, Stavanger (NO); Kjell Einar Ellingsen, Tananger (NO); Bjørgulf Haukelidsæter Eidesen, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 115 days.

This patent is subject to a terminal disclaimer.

(21) Appl. No.: 17/898,919

(22) Filed: Aug. 30, 2022

(65) Prior Publication Data

US 2022/0412038 A1 Dec. 29, 2022

Related U.S. Application Data

(62) Division of application No. 16/472,315, filed as application No. PCT/NO2017/050337 on Dec. 22, 2017, now Pat. No. 11,542,677.

(30) Foreign Application Priority Data

Dec. 23, 2016 (GB) ..... 1622129

(51) Int. Cl.
*E02D 27/52* (2006.01)
*B63B 21/27* (2006.01)
(Continued)

(52) U.S. Cl.
CPC ..... *E02D 27/52* (2013.01); *B63B 21/27* (2013.01); *B63B 21/502* (2013.01); *E02B 17/00* (2013.01);
(Continued)

(58) Field of Classification Search
CPC ..... E02D 27/52; E02D 23/08; E02D 27/50; B63B 21/27; B63B 21/502; E02B 17/00;
(Continued)

(56) References Cited

U.S. PATENT DOCUMENTS 3,307,624 A 3/1967 Lubinski
3,716,100 A 2/1973 Nelson
(Continued)

FOREIGN PATENT DOCUMENTS

CN 103046906 4/2013
NO 20151480 5/2017
(Continued)

OTHER PUBLICATIONS

International Search Report and Written Opinion of the International Searching Authority issued May 3, 2018 in International (PCT) Application No. PCT/NO2017/050337.
(Continued)

*Primary Examiner* — Benjamin F Fiorello
(74) *Attorney, Agent, or Firm* — Wenderoth, Lind & Ponack, L.L.P.

(57) ABSTRACT

A foundation includes connection points. The connection points are configured to permit components to be connected to the foundation and permit loads to transfer from the components into the foundation. The foundation may be a suction anchor.

16 Claims, 5 Drawing Sheets

(51) Int. Cl.

| | |
|---|---|
| ***B63B 21/50*** | (2006.01) |
| ***E02B 17/00*** | (2006.01) |
| ***E02D 23/08*** | (2006.01) |
| ***E21B 33/038*** | (2006.01) |
| ***E21B 41/08*** | (2006.01) |
| *E02B 17/02* | (2006.01) |
| *E02D 27/50* | (2006.01) |
| *E21B 41/10* | (2006.01) |

(52) U.S. Cl.
CPC ..... *E02D 23/08* (2013.01); *E21B 33/038* (2013.01); *E21B 41/08* (2013.01); *E02B 2017/0043* (2013.01); *E02B 2017/0052* (2013.01); *E02B 2017/0078* (2013.01); *E02B 17/02* (2013.01); *E02D 27/50* (2013.01); *E21B 41/10* (2013.01)

(58) Field of Classification Search
CPC ..... E02B 17/02; E02B 2017/0043; E02B 2014/0052; E02B 2017/0078; E21B 33/038; E21B 41/08; E21B 41/10
See application file for complete search history.

(56) References Cited

U.S. PATENT DOCUMENTS

| | | | | |
|---|---|---|---|---|
| 4,036,295 | A * | 7/1977 | Kirkland | E21B 43/013 166/344 |
| 4,120,362 | A | 10/1978 | Chateau et al. | |
| 4,194,857 | A | 3/1980 | Chateau et al. | |
| 4,257,721 | A | 3/1981 | Haynes | |
| 4,387,771 | A | 6/1983 | Jones | |
| 4,438,817 | A * | 3/1984 | Pokladnik | E21B 43/0175 166/344 |
| 4,558,744 | A | 12/1985 | Gibb | |
| 4,591,296 | A | 5/1986 | Henderson, Jr. et al. | |
| 4,611,661 | A | 9/1986 | Hed et al. | |
| 4,653,589 | A | 3/1987 | Alandy | |
| 4,733,993 | A | 3/1988 | Andreasson | |
| 4,832,124 | A | 5/1989 | Davis | |
| 4,932,811 | A | 6/1990 | Folding | |
| 5,069,287 | A | 12/1991 | Short et al. | |
| 7,617,652 | B1 | 11/2009 | Flatmoe | |
| 8,950,500 | B2 | 2/2015 | Lieske, II | |
| 9,359,852 | B2 | 6/2016 | Kebadze | |
| 2004/0200620 | A1 | 10/2004 | Ostergaard | |
| 2011/0129304 | A1 | 6/2011 | Wu | |
| 2012/0024535 | A1 | 2/2012 | Lieske, II | |
| 2012/0138307 | A1 | 6/2012 | Berg | |
| 2013/0220206 | A1 | 8/2013 | Mogedal et al. | |
| 2014/0147215 | A1 | 5/2014 | Foo | |
| 2014/0290379 | A1 | 10/2014 | Lee | |
| 2014/0374113 | A1 | 12/2014 | Kebadze | |
| 2014/0374116 | A1 | 12/2014 | Kelso | |
| 2015/0107845 | A1 | 4/2015 | MacMillan | |
| 2015/0240442 | A1 | 8/2015 | Garcia-Valdecasas Bernal | |
| 2015/0259044 | A1 | 9/2015 | Lopez | |
| 2016/0090709 | A1 | 3/2016 | Mohrfeld | |
| 2016/0265297 | A1 | 9/2016 | Lyle | |
| 2016/0272284 | A1 | 9/2016 | Grossmann | |
| 2017/0130547 | A1 | 5/2017 | Bhatnagar et al. | |
| 2017/0144732 | A1 | 5/2017 | van Wijk | |
| 2017/0183835 | A1 | 6/2017 | Lee | |
| 2018/0163518 | A1 | 6/2018 | Reznicek | |
| 2020/0071904 | A1 | 3/2020 | Safaqah | |
| 2020/0277936 | A1 | 9/2020 | Riemers | |

FOREIGN PATENT DOCUMENTS

| | | |
|---|---|---|
| WO | 9406970 | 3/1994 |
| WO | 99/23350 | 5/1999 |
| WO | 99/64684 | 12/1999 |
| WO | 02/16734 | 2/2002 |
| WO | 02088475 | 11/2002 |
| WO | 2004/018826 | 3/2004 |
| WO | 2010/068119 | 6/2010 |
| WO | 2012/062693 | 5/2012 |
| WO | 2013/049194 | 4/2013 |
| WO | 2013/050411 | 4/2013 |
| WO | 2013/167872 | 11/2013 |
| WO | 2015/043856 | 4/2015 |
| WO | 2015/054766 | 4/2015 |
| WO | 2015/118348 | 8/2015 |
| WO | 2016/200271 | 12/2016 |
| WO | 2017/155415 | 9/2017 |
| WO | 2017/179992 | 10/2017 |

OTHER PUBLICATIONS

Search Report issued Jun. 22, 2017 in GB Application No. 1622129.3.

Search Report issued Aug. 31, 2017 in GB Application No. 1622129.3.

Office Action issued May 13, 2021 in U.S. Appl. No. 16/471,013.

Office Action dated Mar. 22, 2024 in U.S. Appl. No. 17/898,806.

* cited by examiner

FOUNDATION MODULARIZATION

BACKGROUND OF THE INVENTION

1. Field of the Invention

The invention relates to subsea assemblies that comprise a subsea foundation. For example, the foundation may be a suction anchor. The foundation may be a foundation for a subsea well. More specifically the invention may be concerned with standardizing and/or modularizing a subsea assembly comprising a foundation.

2. Description of the Related Art

It is known to use a subsea foundation, such as a suction anchor, for equipment such as a subsea pump station or as the foundation of a subsea well. The suction anchor comprises a skirt and horizontal lid that define a volume in which the pressure can be adjusted relative to the outside environment.

To install the subsea assembly comprising a suction anchor, the suction anchor is lowered onto the seabed and then sucked into the seabed by reducing the pressure inside the skirt.

When the foundation is a foundation for a subsea well, a well may extend through the foundation into the sea bed.

There will typically be many standard components that it is desired to mount or attach to a subsea foundation. For example, in a subsea well there will generally be a number of standard components, such as the high pressure wellhead housing, and wellhead equipment such as a blowout preventer (BOP), that it is desired can be used in a subsea well irrespective of the particular well. However, certain aspects of the assembly may need to change depending on factors such as function, location, geology etc. For example, a different type or different size foundation may be required depending on the sea floor geology.

It is desired to standardize and modularize certain aspects of the subsea assembly so that variable and standard modular components can be used together.

SUMMARY OF THE INVENTION

The following disclosure describes a number of features of a subsea assembly (such as a well assembly) that may be provided together or independently of the other features disclosed herein. It should be appreciated that each of the different aspects may be independently patentable and/or provided independently of the other features disclosed herein. Additionally, one or more of the features may be provided in combination to improve the subsea assembly.

In an aspect the present invention and disclosure is concerned with an assembly that allows standardizing, modularizing, and/or simplifying a subsea assembly, such as a well assembly, comprising a subsea foundation such as a suction anchor.

The subsea assembly comprises a foundation (e.g. a suction anchor) that may act as a foundation for a subsea device. The subsea device may be a subsea well and optionally the associated wellhead equipment. The subsea device may for example be any known subsea device such as a pump station, a separator, a compressor, a manifold, a control center, a smart manifold, a control hub, power/hydraulic power unit, power equipment, gas compressor module and/or cooler etc.

The foundation may be, or may be suitable for, being fixed, e.g. rigidly connected, to the seafloor. For example, the foundation may be cemented to the sea floor, fixed thereto by piles and/or suctioned onto the sea floor etc.

If the foundation is a suction anchor, the suction anchor may comprise an outer skirt and a horizontal top plate that together define a volume in which the pressure can be adjusted relative to the outside environment.

The foundation may have a central pipe therethrough that a well may extend through (in the case that the foundation acts as a foundation of a subsea well assembly). The central pipe may be or receive a low pressure conductor housing of a well.

In the case that the foundation is a suction anchor, the central pipe may result in the volume in the suction anchor in which the pressure can be adjusted being an approximately annular volume. The annular volume may be located around the central pipe.

When the suction anchor is on the seabed, the volume may be sealed (this may for example be due to the weight of the suction anchor forcing the bottom of the skirt and (if present) the central pipe into the seabed to seal the internal volume relative to the outside environment). As a result, pressure inside the suction anchor may be reduced so as to suck it into the seabed.

A well may extend through the foundation, e.g. suction anchor, into the sea bed.

In one aspect, the present invention may comprise a foundation, e.g. suction anchor, for a subsea assembly (e.g. subsea well assembly), wherein the foundation comprises one or more connection points.

The foundation/suction anchor may provide the foundation of the assembly.

The connection points may permit other components to be connected to the foundation and may permit load transfer from the component connected to the connection point into the foundation. When the foundation is installed on a seabed, the connection points may permit load transfer from the component connected to the connection point to the seabed via at least part of the foundation. When the foundation is for a subsea well, the connection points may permit wellhead load relief. This is because at least some loads may be transferred into the sea bed via the foundation rather than via the wellhead. Thus, a wellhead load relief device may be connected between the strong points on the foundation and a component that is mounted/connected to the wellhead.

Loads may be transferred both tension and compression when the foundation is fixed to the seabed.

The connection points may provide a point for and/or means to allow load transfer from the component connected to the connection point into the foundation and thus may be ultimately into the sea floor.

One or more or each connection point may have a predefined, well known and/or standardized attachment profile to allow the load transfer and/or locking of components attached to the connection point.

One or more, or each of the connection points may have a profile that permits load transfer and/or locking of the component that is connected to the connection point.

The connection points may additionally or alternatively be used as connection/gripping points for other components that are not associated with the components mounted on the foundation.

For example, the connection point may be used (e.g. temporarily) as an anchoring point for a device such as an ROV whilst it is exerting force and/or moving other components. The connection point may thus act as a 'reaction' point.

The connection points may be used as a receiver of loads occurring during installation, such as lifting loads (gravity), as reaction points during the tie in of flow lines and umbilicals and as an anchoring support point for components, such as flowlines and umbilicals, connected to components mounted on the foundation.

The connection points may be used as points to hold the suction anchor during installation and/or removal of the suction anchor, i.e. they may be used as lifting points.

Alternatively, the connection points may not be used during the installation of the foundation. The connection points may only be used once the foundation is fixed to the seabed.

Irrespective of the component connected to the connection point, the connection may provide a locking, centralizing, and/or locating function etc.

The connecting (e.g. locking, centralizing, locating (e.g. height adjustment) etc.) may occur as the assembly is installed, e.g. orientation, or it may occur at a desired time after the installation has occurred, e.g. locking by manipulation of a locking mechanism or height adjustments made by a mechanism after installation.

One or more, or each connection point may comprise a hole or socket or a protrusion (such as a pin) to allow the connection to a component. The connection point may have a profile that may be provided by an insert or adapter connected to the connection point to allow the connection such that it permits load transfer and/or locking via the connection point.

The connection point may be designed to have an adjustable height, i.e. adjustable length. This may be for example achieved by means of an adjustable insert. The height of the connection points may be independently adjustable. Independent height adjustment features on individual connection points may permit component position and/or inclination to be adjusted.

One or more, or each connection point may be an additional part that protrudes from the main body of the foundation to provide an attachment point for parts mounted on the foundation (such as a support device/structure as discussed below)

The connection points may be referred to as strong points. One or more, or each connection points may be designed to be load bearing points.

The connection points may be designed to transmit forces in compression and/or tension to the foundation from the components connected to the connection points.

One or more, or each connection points may be reinforced points.

One or more, or each connection points may be stronger than the adjacent parts of the suction anchor.

One or more, or each connection point may be provided at the outer perimeter (e.g. outer circumference in the case of a cylindrical suction anchor) of the foundation. In the case that the foundation is a suction anchor, one, more, or each connection point may be attached (e.g. directly) to the suction skirt of the suction anchor.

One or more, or each connection point may be an integral part of the foundation. One or more, or each connection point may be integrally formed with the foundation or the connection point may be a component that is welded, or otherwise fixed to the foundation.

The foundation may have a plurality of (such as four) connection points that one or more components can be connected to.

In the case that the assembly comprises a plurality of connection points, the connection points may be provided at spaced locations around the outer perimeter (e.g. outer circumference in the case of a cylindrical suction anchor) of the foundation. The connection points may be substantially equally (including exactly equally) spaced around the perimeter of the foundation. For example, in the case of a foundation with four connection points the connection points may be approximately 90 degrees from the adjacent connection points. This may allow load transferred via the connection points to be evenly distributed over the foundation.

The connection points may be located relative to each other in a predetermined and/or known arrangement. The connection points may be set distances apart. This means that the interface required for components connecting to the connection points may be known. Components that are to be connected to the connection points may have an appropriately designed interface.

The component attached/to be attached to the one or more or each connection point may be a component to be mounted on the foundation (e.g. the support device and/or the subsea equipment adapter frame). Additionally or alternatively the component attached/to be attached to the one or more or each connection point may be a protective structure. The protective structure may be attached to the connection points when the well assembly is not being used (i.e. during periods of time where the assembly is left alone).

The protective structure may be attached to the connection points when the well assembly is producing or injecting (i.e. during periods of time where the assembly is left alone and actively used according to its intended purpose).

The protective structure may protect the assembly against dropped object impacts and fishing gear impacts for example. The component attached/to be attached to the one or more or each connection point may be an ROV, flow lines or umbilicals for example.

One or more, or each connection point may be provided towards or at the upper surface of the foundation (i.e. at or near the height of the top plate in the case of a suction anchor foundation). One or more, or each connection point may be at a location that is above the seabed when the foundation is fixed to the seabed, e.g. when a suction anchor foundation is sucked into the seabed.

One or more, or each connection point may comprise a base portion integral with the foundation. For example the base portion may be fixed (such as welded) directly to the foundation or integrally formed with the foundation.

One or more, or each connection point may comprise a connection portion. The connection portion may be the part of the connection point to which the component is attached.

The connection portion and base portion may be distinct parts (yet still may be integral).

One or more or each connection portion may comprise or be arranged to be connected a guide device. For example, the guide device may comprise a protruding member. The protruding member may be a guide post. The guide device may additionally or alternatively comprise a guide funnel.

The subsea assembly may comprise a one or more guide devices (e.g. guide posts). These may be part of the connection point or connected to the connection point.

The connection point may be connected to a guide device and during a different phase of operation connected to a different component such as a load relief device. For example, during installation the connection points may be connected to a guide device to help guide components such as a BOP onto the foundation and/or wellhead and during drilling and/or production the connection points may be connected to a wellhead load relief device such as a rigid connector for transmitting loads between the component and the foundation in both tension and compression.

The connection points may be connected to different components throughout the lifetime of the subsea foundation. Thus the connection points may be multi-purpose and may increase the flexibility of how the subsea foundation can be used.

The present invention may provide a method of using the subsea foundation with the connection points, wherein the method comprises connecting a first part, or no part, to one or more of the connection points during a first phase of operation and connecting a second different part to one or more of the connection points during a second phase of operation.

The guide device when attached to the connection point may extend beyond the top of the foundation, e.g. beyond the top plate in the case of a suction anchor foundation.

The connection portion (or another part of the connection point) may act as a receptacle for receiving a part of a component such as a respective guide device (e.g. a protruding member). The guide device when received in the connection point may extend beyond the top horizontal surface of the foundation, e.g. beyond on the top of the suction can in the case of a suction anchor foundation. Each guide device may provide a means to which the components can be attached, a means for transferring loads (such as lateral loads from the components to the suction anchor), a means for guiding the components into the correct position and orientation on the suction anchor and/or a means to which guide wires can be attached during an installation procedure.

The guide device may be used to orient and position components relative to the foundation, e.g. relative to a wellhead in the case that the foundation supports a wellhead.

When there are a plurality of guide devices (e.g. guide posts), one guide device may be reached first (e.g. it may be longer and/or extend further above the top plate of the suction anchor) than the other guide devices.

For example, when there are a plurality of protruding members (e.g. guide posts), one protruding member may be longer (i.e. extend further above the top plate of the suction anchor) than the other protruding members.

This may aid guiding components onto the top of the subsea assembly. When a component is lowered to be received on the top of the foundation the guide devices may be used to guide the components into the correct position. When one guide device is reached first, the orientation of the component may be adjusted when only in contact with that guide device so that the component may be appropriately orientated to align with the other guide devices. For example, in the case of the guide devices being protruding members, the longest protruding member may be used to align the component at one point about which the component can be rotated to line it up with the other protruding members before being lowered onto the other protruding members. This may make it easier to mount components on the subsea assembly.

During installation the component being attached (e.g. the support device and/or the subsea equipment adapter frame) may be guided and received first by the longest (i.e. first reached)) guide device. This may hold the component in a certain position relative to the foundation and/or wellhead and the component may then be rotated about the longest guide device before lining up with the other guide devices. Thus, by having one guide device that is longer than the others, installation can be made more reliable and installation time may be reduced.

The subsea assembly may comprise fine alignment device(s); these for example may be locking posts. These fine alignment devices may be used in conjunction with the guide devices (e.g. guide posts) to help position and/or lock the components on the foundation. The guide devices may be used to guide the component (e.g. support frame and/or production support) into approximately the correct location and orientation on the foundation and the fine alignment device(s) may be used to precisely locate the components and/or lock them to the subsea installation. The fine alignment device(s) may be machined to a high tolerance to ensure that the components are aligned and/or locked in a precise location relative to the foundation and/or wellhead.

Additionally and/or alternatively the fine alignment device(s) may be adjustable (for example in a slot along which it can be moved and then fixed). For example the fine alignment device(s) may be adjusted during integration testing of components to be mounted on and/or connected to the foundation in order to obtain a final precise location of components during installation.

The guide devices may be used as a coarse guiding means and the fine alignment devices may be used as a fine guiding/aligning means.

The fine guiding/aligning may be in one or several rotational or translational directions.

Whilst the geometry, size, type etc. of the foundation may vary based on factors such as the geology the connection points may be unchanged by these conditions, i.e. standardized. The connection points may for example be a size and/or location that are independent of the foundation, such as in the case of a suction anchor foundation, independent of the length of the suction anchor. As a result, it may be possible to have a foundation that is bespoke (or at least chosen from a few different foundation designs) whilst the connection points are standardized. This may allow bespoke or at least different foundation designs to connect to the same components.

Thus the present invention may comprise providing a plurality of foundations for a subsea assembly of different designs (e.g. different sizes, lengths, and/or geometries) wherein the connection points on each foundation are located in the same position relative to the other connection points and/or the connection points are the same size.

Additionally, a foundation may be provided with the connection points irrespective of its function. The connection points may be used during different phases of use of a foundation. For example, when the foundation is for a subsea well, the connection points may be used during different phases such as drilling, production, installation and retrieval. In one or more or each phase, different components may be connected to the connection points. This may, for example, be when the well is an exploration well and/or when it is a production well.

A foundation that is for an exploration well assembly may be provided with connection points. This may mean the exploration well assembly can be converted to a production well assembly after a period of time it has been operating as an exploration well. The decision to convert the well from an exploration well to a production well may be made after the well has been operating as an exploration well for a period of time.

A well that can be converted from an exploration well to a production well may be referred to as a keeper well. This process of converting an exploration well to a production well may help to reduce the overall costs of a project.

This is because a new foundation does not need to be installed for the production well but instead the exploration well foundation can be 'converted' by attaching components (such as components to be mounted on the foundation, such as a support device and/or a subsea equipment adapter frame, and/or components that connect to the foundation such as a protection structure and fluid connections such as flowlines and controls umbilicals etc.) onto the foundation after it has been decided to convert an exploration well into a production well. The components may be separate disconnectable parts from the foundation.

The conversion may be achieved using the connection members that are already provided on the foundation and because the support device and/or a subsea equipment adapter frame are separately installable components.

The conversion may be decided after the well has been operating as an exploration well and positive indications of the producible value of the well is verified through the drilling of the exploration well. At that stage the necessary components for the conversion may be manufactured and installed. This may ensure that investments are made on the basis of confirmed information and not estimates.

Typically, an exploration well would be installed to search for suitable/desirable locations to install production wells. Once a suitable location was identified a production well would be installed. As a result the process would require two wells, an exploration well and then a production well. It has been realized that by providing a foundation with connection points, a foundation may be used in an exploration well assembly and if it is found that the well has been installed in a location where a production well is desired, the exploration well can be converted to a production well. This may be achieved by connecting components required for a production well assembly to the foundation via the connection points.

In another aspect, the present invention may provide a method of converting an exploration well into a production well, the method comprising: providing an exploration well assembly, the exploration well assembly comprising a foundation (the foundation acting as a well foundation), wherein the foundation comprises one or more connection points (that may have one or more of the above described features), converting the exploration well assembly to a production well assembly, wherein converting the exploration well assembly to a production well assembly comprises connecting one or more components to the foundation via the one or more connection points.

In this way, it may be possible to provide an exploration well at relatively low cost (as the foundation can be kept simple) but provide it with the means to allow it to be converted into a production well. This is achieved by providing connection points on an exploration well to allow components that are required for a production well to be fixed to an exploration well so as to convert it to a production well.

The method may comprise determining whether the exploration well assembly is in a location desired for a production well. If it is determined that the exploration well assembly is in a location desired for a production well, the exploration well may be converted into a production well by connecting one or more components to the foundation via the one or more connection points.

No components may be connected to the connection points when the well assembly is being used as an exploration well.

The connection points may be used when the exploration well is being installed, e.g. as lift points.

The connection points may be used as a point to which components mounted on a well head e.g. a BOP, can be connected. This may for example be during drilling operations. This may be used as a means to minimize loads from the component on the wellhead being transferred into the high pressure well head housing.

The connection points may be used to connect components such as a protection structure to protect the subsea well assembly. This may for example be during the time intervals between installation until drilling operations start, and from when drilling operations stop until removal of the well and/or conversion to production well commences and a permanent protection structure may be installed.

The subsea well assembly may comprise a support device, i.e. support structure. For example, the support device may be a support frame. The component connected to the connection points may be the support device. The support device may also be referred to as equipment support device and/or a protection support.

The equipment support device may be used to support equipment mounted on the foundation. This may be any subsea equipment such as a pump station, a separator, a compressor, a manifold, a control center, a smart manifold, a control hub, power/hydraulic power unit, power equipment, gas compressor module, cooler and/or well production equipment etc.

The equipment support device may not provide any lateral support to a wellhead in the case of a subsea well assembly.

The support device may provide a landing surface for components mounted on a subsea foundation. The support device may additionally and/or alternatively be a structure on which on which components may be pre-mounted before the support device is taken subsea. This may provide a convenient means to install components together and in present easily controllable locations relative to each other. The support device may be used to transfer and/or distribute loads into the foundation and ultimately into the sea floor.

The support device may be received on the foundation (such as on the top plate of a suction anchor in the case that the foundation is a suction anchor).

The support device may extend beyond the outer perimeter of the foundation on which it is mounted. Thus, the support device may increase the surface area on which components supported by the foundation can be mounted. The support device may thus act as a balcony (i.e. overhang) from the foundation.

The support device may also provide receptacles for guide devices (such as guide posts).

The support device may provide support and/or a surface/interface on which further components (such as a subsea equipment adapter frame) can be mounted.

The present invention may comprise providing a plurality of subsea assemblies (e.g. wellhead assemblies), wherein each assembly comprises a foundation of different designs and a support device, wherein the support device has the same size (e.g. the same height)/and/or connection points and/or upper interface for each assembly irrespective of the size and/or design of the foundation.

The support device, e.g. its outer frame a may be connected to the foundation via one or more connection points.

The connection points may provide an interface between a foundation and components thereon, such as the support device and subsea equipment adapter frame.

The support device may be a component that is separate from and/or additional to the foundation. The foundation and the support device may be modular components of the subsea well assembly. Whilst (as discussed above) the foundation shape and size may vary between installations, the support device may be standardized. This may allow different installations to have a standardized interface for equipment and other components to be located on.

The support device may be mounted on or arranged to be mounted on the foundation, e.g. the top plate of a suction anchor.

The support device may be connected to the foundation via one or more connection points (that may have one or more of the above described features).

The support device may be connected to the foundation such that loads may be transferred from a component connected to the support device into the foundation and may be transferred and/or dissipated into the sea bed (i.e. soil or formation).

The support device may be detachably fixed to the foundation. Alternatively, the support device may be permanently fixed to the foundation, such as by welding.

The support device may be fixed to the foundation before it is deployed subsea or the support device may be fixed to the foundation when the foundation is deployed subsea, such as after it has been fixed to the sea bed, e.g. sucked into the sea bed in the case of a suction anchor.

If an exploration well assembly is being converted to a production well assembly the method may comprise installing a support device on the foundation after it has been decided to convert the assembly.

The subsea assembly may comprise a subsea equipment adapter frame. This may be a frame (e.g. standardized frame) on which subsea equipment (e.g. valves and pumps) can be mounted.

The subsea equipment adapter frame may have an interface that is standardized to complement the surface, e.g. support device or foundation, on which it is mounted and a bespoke interface to complement equipment that is to be mounted on the subsea assembly. In other words, the adapter frame may act as an interface between a standard support device and a supplier specific connection.

The adapter may act as means to make the equipment and/or components mounted thereon, such as valves, sensors, pump etc., retrievable. This may aid maintenance and/or improve reliability of the assembly.

In the case that the assembly is a subsea well assembly, the foundation may comprise one or more well head supports that, in use, provide lateral support to the wellhead extending through the foundation. In the case that the foundation is a suction anchor, the wellhead supports may be located within the internal volume of the suction anchor. In this case, the support device may be mounted directly on the top plate of the suction anchor.

As discussed in more detail below, the wellhead supports may be on top of the top surface of the foundation, e.g. top plate of the suction anchor external to the internal volume of the suction anchor. In this case, the support device may be received on the wellhead supports. Alternatively the support device may have an interface that complements the interface of the wellhead supports such that the support device is still received on the top surface of the foundation, e.g. top plate of the suction anchor, between the wellhead supports.

The support device may thus be in a plane above the wellhead supports, in line with the plane of the wellhead supports or even below the plane of the wellhead supports.

The planes of the support device and the foundation top may be approximately at the same inclination. This may be achieved by adjusting the plane of the support device connected to the connection points until it approximately matches the inclination of the top of the foundation.

The subsea assembly may comprise a foundation, a support device/frame and a subsea equipment adapter frame. These components (if present) may be separate components. These components may be installed and/or uninstalled separately. For example, first the foundation may be installed and fixed to the sea bed, e.g. sucked into the sea bed, next the support device may be installed onto the foundation and fixed thereto, e.g. via one or more of the connection points, next if present in the assembly, the subsea equipment adapter frame may be mounted onto and/or fixed to the support device/frame. The reverse may be done to uninstall a wellhead assembly.

The present invention may provide a method of installing a subsea assembly, the subsea assembly comprising a foundation and a support device, wherein the foundation is installed on a sea bed and then (e.g. after the foundation has been fixed to, e.g. sucked into, the sea bed and/or other components (such as a well head in the case of a subsea well assembly) have been installed) the support device is mounted on and/or fixed to the foundation.

The present invention may provide a method of uninstalling a subsea assembly, the subsea assembly comprising a foundation and a support device, wherein the support device is dismounted from and/or unfixed from the foundation, and then the foundation is uninstalled from the sea bed. Final removal of the assembly may be made using the retrievability of assembly components to ease, simplify and reduce cost of the removal operations.

By providing a foundation, support device and subsea equipment adapter frame as separate (e.g. modular) components that may be installed and/or uninstalled separately, the assembly may be more flexible. For example, it may be possible with this assembly to convert an exploration well to a production well and/or provide different subsea equipment adapter frame depending on the equipment being used with the well.

The foundation, support device and/or subsea equipment adapter frame may be detachably fixed to each other. Alternatively, these components may be permanently fixed to each other, such as by welding.

An exploration well may be converted to a production well by attaching a support device/frame and/or a subsea equipment adapter frame (e.g. production support) onto the foundation. Thereafter production equipment may be mounted on the subsea well assembly to allow the well to function as a production well rather than an exploration well.

Alternatively, the foundation, support device/frame and/or subsea equipment adapter frame may be fixed together before the assembly is deployed subsea.

The support frame and/or subsea equipment adapter frame may be standardized and have a size, geometry and/or interface (e.g. the interface facing away from and/or towards the foundation) that is independent (i.e. the same irrespective) of the size of the foundation (that may vary e.g. due to the geology). This may be possible if the foundation has standardized connection points as discussed above.

Subsea equipment, e.g. a Christmas tree or a BOP, may be mounted on the subsea assembly, e.g. on the wellhead.

The support frame and the subsea equipment adapter frame may have a central opening to allow them to be installed and/or retrieved over subsea equipment such as a BOP and/or a Christmas tree if they are already mounted on the wellhead.

If the assembly comprises a plurality of foundations, e.g. two, the support frame and/or subsea equipment adapter frame may extend over at least part of each foundation and/or be connected to at least one connection point on each foundation.

In the case that the subsea installation comprises two or more foundations, the support frame may be used to ensure that there is a certain pre-set distance between adjacent foundations. A single support device and/or subsea equipment adapter frame may be used for a plurality of foundations.

When the foundation is a foundation for a subsea well, it may comprise a wellhead support structure.

When the foundation is suction anchor, it may be a suction anchor for a subsea well (e.g. the suction anchor may provide or is for providing the foundation of a subsea well), wherein the suction anchor comprises: a skirt; a top plate; a pipe that is for a well to extend through, wherein the skirt, top plate and pipe together define an internal volume in which the pressure can be adjusted relative to the outside environment, and a wellhead support structure, wherein the wellhead support is at least in part external of the internal volume.

Typically, when a suction anchor acts as the foundation for a subsea well, the well extends through the suction anchor and one or more wellhead supports are provided inside the suction anchor's internal volume. At least some of these well head supports are provided towards or at the top of the internal volume near the top plate.

It has been realized that there may be several advantages if the wellhead support is at least in part external of the internal volume of the suction anchor.

The wellhead support may be outside/above of the volume inside the suction anchor in which the pressure can be adjusted.

The wellhead support may be integral with the foundation, e.g. suction anchor (e.g. the top plate and/or the suction skirt). The well head support may be integrally formed with the foundation and/or welded to foundation.

The wellhead support may reinforce the foundation, e.g. suction anchor top plate from above. This means for example, in the case of a suction anchor foundation, that the suction anchor (i.e. top plate) may be to be able handle a larger implosive differential pressure as the suction anchor is being sucked into the sea bed compared to an arrangement without the external wellhead support.

Thus, the wellhead support may have a dual function of laterally supporting the wellhead and reinforcing the foundation, e.g. the top plate of the suction anchor.

In the case of a suction anchor foundation, when the assembly comprises a wellhead support structure that is external of the internal volume, there may not be any wellhead supports inside the top half of the suction anchor volume connecting the central tube to the suction skirt (other than the top vertical plate). This may reduce the volume of material that has to be sucked into the seabed and/or that may cause friction against the auction anchor being sucked into the sea bed.

The well support structure may provide support for a wellhead of the subsea well assembly and/or provide a surface/interface on which further components (such as a support device as discussed above) can be mounted.

The well support structure may comprise one or more support members. The well support members may provide lateral support to the wellhead.

The well support structure may provide axial support to the wellhead.

The well support structure may be arranged so that in use it can be fixed relative to the wellhead. There may be a locking means between the wellhead and the support. This may mean that the wellhead is rigidly connected to the well support structure and hence to the foundation and/or the seabed.

The assembly may be arranged so that the wellhead cannot move laterally and/or axially relative to the wellhead support structure.

The well support structure may support the wellhead from loads due to thermal growth. These may for example be due to thermal growth during production and/or injection operations.

The well support structure may rigidly fix the wellhead to the foundation. As a result the well support may aid thermal growth arrestment. The well support structure may transfer a thermal growth arrestment load to the foundation and/or the seabed.

The well support structure may allow the loads from the wellhead, e.g. bending moments, lateral loads, axial loads, and/or loads due to the thermal growth etc., to be transferred into the foundation and/or into the sea bed.

The well support members may provide a force couple to support the wellhead, i.e. to help resist bending moments that are applied to the wellhead. Without the well support members a force couple may be provided between the top and bottom of the foundation, e.g. between the top plate of the suction anchor and internal reinforcing members that extend between the suction skirt and the central pipe at or towards the bottom of the suction anchor. Given that this length, e.g. the length of the suction anchor between assemblies, can vary, the force couple may also vary. By providing well support members on the foundation, e.g. on the top plate of the suction anchor, the force couple may instead by provided by these parts. These parts may have a height that is independent of the foundation, e.g. independent of the length of the suction skirt and thus the force couple may be standardized (i.e. it may be a certain value irrespective of the size/geometry of the suction skirt). The height of each well support member may be 0.5 to 1.5 m, e.g. about 1 m. This may be the height irrespective of the size of the foundation.

The well support members may each be a member that extends in a radial direction. The well support members may each be a beam, e.g. a plate. The plane of each well support member may be substantially parallel to the axial and a radial direction of the wellhead.

One or more, or each well support member may have a uniform cross sectional characteristics (such as profile or strength). Two or more or each well support member may have an equal size.

One or more, or each well support member may have cross sectional properties and/or sizes that vary along their length (either along part of the length or over the entire length). This variation may be constant along the length or non-constant, such as an abrupt change. For example the well support member(s) may have a tapered height. This may taper away from the wellhead.

The well support may connect the wellhead to the foundation, e.g. top plate and/or suction skirt of a suction anchor. This may allow loads to be transferred from the wellhead through the foundation into the sea bed.

The well support members may be located around the wellhead. The support members may be spaced radially around the wellhead. This may allow the support members to provide support that is fairly evenly distributed around the wellhead.

The well support may comprise an outer frame. The well support members may extend between the outer frame and the wellhead.

The outer frame may have an outer shape that is different to that of the foundation perimeter. For example, the foundation may be circular and the outer frame may be square.

The outer frame may be larger than that of the foundation.

When the subsea well assembly comprises a well support on top of the foundation, the wellhead may protrude from the top of the foundation, e.g. top plate of the suction anchor, more than an assembly without a well support on the foundation.

In other words, the top of the foundation, e.g. top plate of the suction anchor, may effectively be lowered (e.g. the height of the volume in the suction anchor decreased) compared to an arrangement without a well support structure. This may mean that the height of the annular volume in which the pressure can be adjusted may be reduced.

In an arrangement without a well support, due to the loads that are put on a wellhead when equipment is mounted on the wellhead, the wellhead is designed to protrude less from the top of the foundation, e.g. suction anchor. This is so that the wellhead can be laterally supported by the foundation (e.g. by a force couple set up between the top and bottom, e.g. in the case of a suction anchor, the top plate (and/or internal wellhead supports near the top plate) and internal reinforcing plates near the bottom of the suction skirt). This means that in an arrangement without a well support most of the wellhead may be located below the top of the foundation, e.g. within the suction skirt and as a result it may not possible or more difficult to access the wellhead.

When the subsea well assembly comprises a well support on the foundation, e.g. on the suction anchor external of the internal volume, the wellhead may protrude from the top of the foundation and not be enclosed within/below the foundation. The well support may be an open structure, such as comprising a plurality of radially extending well support members (e.g. plates or beams). This structure may leave parts (e.g. at least a height of 1 meter or at least down to a point below where the high pressure wellhead housing seals to the low pressure wellhead housing) of the outer surface of the top of the wellhead exposed to the outside environment (i.e. not covered by a wellhead support and not within/below the foundation, e.g. within the volume of the suction anchor). This may mean that it is possible/easier to access the wellhead whilst still ensuring that it is laterally supported to the required extent.

The well support may connect to connection points on the foundation. The well support may help reinforce and strengthen the connection points of the foundation. The connection points may be those discussed above.

BRIEF DESCRIPTION OF THE DRAWINGS

Certain preferred embodiments of the present invention will now be described by way of example only with reference to the accompanying drawings, in which.

DETAILED DESCRIPTION OF THE INVENTION

Figure 1:
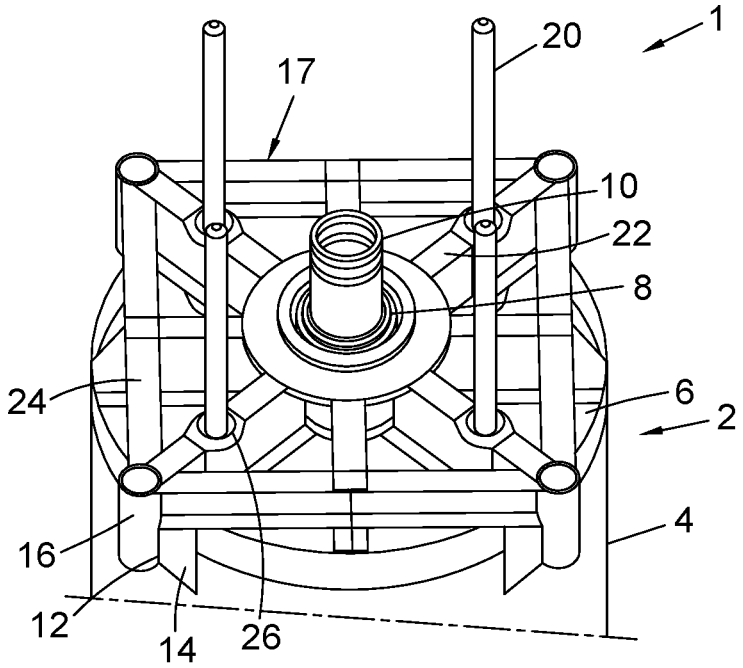
FIG. 1 is a perspective view of the top of a first subsea well assembly.

FIG. 1 shows part of a subsea well assembly 1. Whilst the invention is described in relation to a subsea wellhead assembly, many aspects of the invention (except those specifically related to the features of wells) are applicable to other subsea assemblies that comprise a foundation. Thus, the following description should be understood where appropriate to apply to any subsea assembly with a foundation. The subsea well assembly 1 comprises a foundation 2 which in this case is a suction anchor. The suction anchor 2 comprises an outer suction skirt 4 around a central tube and a top plate 6 connecting the outer suction skirt to the central tube to form an internal volume inside the suction anchor 2 that is a sealed volume when the suction anchor 2 is on the sea floor and has penetrated the sea floor slightly. This penetration may be due to its own weight or due to putting extra downward force on the top of the suction anchor 2 when it is resting on the seafloor.

The suction anchor 2 may be sucked into the sea floor by reducing the pressure inside the suction anchor 2 to thereby provide a subsea well foundation in the seabed.

The central tube may be or receive a low pressure wellhead housing 8 in which is received a high pressure wellhead housing 10.

Figure 2:
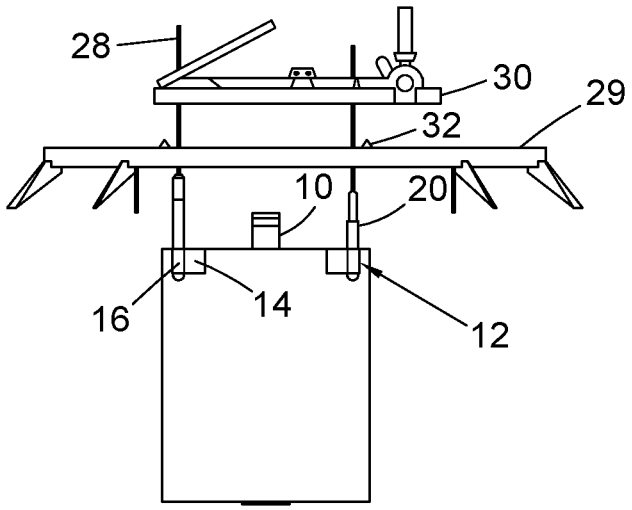
FIG. 2 is a side view of a second subsea well assembly.

The suction anchor 2 comprises a plurality (there are four in the example of FIG. 1) of integral connection/strong points 12. These connection points 12 are stronger than the adjacent parts of the suction anchor 2 and provide a strong point for components to be connected to the suction anchor 2 such that load can be transmitted into the suction anchor 2 and thus into the sea floor. The connection points 12 are located equally spaced around the top of the suction skirt 4 of the suction anchor 2. The connection points 12 are integral (e.g. welded or integrally formed) with the suction anchor 2. Each connection point has a base portion 14 and a connection portion 16. The base portion 14 is fixed to the suction anchor 2 (e.g. on the suction skirt). The connection portion 16 protrudes from the top of the suction anchor 2 and provides a part to which other components such as a support frame can be connected. The connection portion 16 may also comprise a receptacle for receiving a guiding device such as guide post 20 as shown in FIG. 2.

The receptacle may have a standard interface to allow it to be locked to the component it receives and for loads to be transferred from the component into the connection points.

The assembly 1 in FIG. 1 shows a wellhead support 17 mounted on the suction anchor 2. The wellhead support 17 is external of the internal volume of the suction anchor 2. The wellhead support 17 may connected to the suction anchor 2 via the connection points 12 and/or be directly attached to the top plate 6. The wellhead support 17 may for example be welded to the connection points 12 and/or the top plate 6. The wellhead support 17 may also support the connection points 12.

The wellhead support 17 may rest on the top plate 6 of the suction anchor 2. The wellhead support 17 may have a plurality of wellhead support members 22 (in this case eight). The wellhead supports 22 may provide lateral support to the wellhead 8 and allow the transfer loads from the wellhead 8 into the suction anchor 2. The wellhead supports 22 each comprise vertical plates (e.g. I-beams) that are spaced around the circumference of the wellhead 8 outside of the internal volume of the suction anchor. This allows the wellhead support members to provide lateral support to the wellhead 8 distributed around its circumference whilst leaving parts of the wellhead 8 exposed for wellhead interventions. The wellhead supports 22 may be connected via an outer frame 24. Thus the wellhead support 17 may comprise the wellhead supports 22 and the outer frame 24. The outer frame 24 may rigidly connect the wellhead support members 22 and be used to connect the wellhead support 17 to the suction anchor 2 via the connection points 12.

The well support 17 may also comprise one or more receptacles 26 for receiving guide devices 20 (e.g. guide posts). These protruding members 20 may provide a means to which components can be attached, a means for transferring loads (such as lateral loads from components mounted on the assembly 1 to the suction anchor 2), a means for guiding the components into the correct position and orientation on the suction anchor 2 and/or a means to which guide wires 28 can be attached during an installation procedure (as shown for example in FIG. 2).

The well support 17 may be integral with the suction anchor or a separate modular component from the suction anchor 2 and may be installed separately from the suction anchor 2.

The well support 17 may provide a surface on which components mounted on the subsea assembly 1 may rest. For example, equipment support structure 29 or subsea equipment adapter frame 30 may be located on the wellhead support 17. The subsea equipment adapter frame 30 may be a separate modular component from the suction anchor 2 and the well support 17 and/or the equipment support structure 29 and may be installed separately from the suction anchor 2 and equipment support structure 29.

A suction anchor 2 with connection points 12 may be installed and used as an exploration well. If it is desired to convert the suction anchor 2 from an exploration well to a production well this may be possible by using the connection points 12 to connect equipment support structure 29 and subsea equipment adapter frame 30 to the suction anchor 1.

To install the equipment support structure 29 and/or the subsea equipment adapter frame 30 on a preinstalled suction anchor 2, guide posts 20 may be installed on/in the connection portions 16 of the connection points 12 (see for example FIG. 2). Guide wires 28 may be connected to the guide posts 20. The guide wires 28 may be passed through apertures in the equipment support structure 29 and subsea equipment adapter frame 30 and used to guide these components into roughly the correct location above the wellhead and onto the guide posts 20.

As shown in FIGS. 2,3, 6 and 7 for example, one of the guide posts 20 may be longer than the other guide posts 20. This is so that this longer guide post 20 is received first in an aperture in the component being mounted and at that point provides a point about which the component can be rotated to get it in the correct location to be received by the other guide posts 20. This may make the installation easier as first the component can be translated to align an aperture with the longer guide post 20 and then rotated to align the other apertures with the other guide posts 20.

Once the component (e.g. the equipment support structure 29 and/or the subsea equipment adapter frame 30) being mounted has been roughly aligned relative to the wellhead 10 using the guide posts 20, the component may be precisely aligned using one or more fine alignment members 32. These fine alignment members 32 may be used in conjunction with the protruding members (e.g. guide posts 20) to help position and/or lock the components on the suction anchor foundation 2. The protruding members 20 may be used to guide the component (e.g. equipment support structure 29 and/or subsea equipment adapter frame 30) into approximately the correct location and orientation on the suction anchor 2 and the fine alignment members 32 may be used to precisely locate the components and lock them to the subsea installation 1. The fine alignment members 32 may be machined to a high tolerance to ensure that the components are located and/or locked in a precise location relative to the suction anchor 2 and/or wellhead 10. In other words, the guide posts 20 may be used as a coarse guiding means and the fine alignment members 32 may be used as a fine guiding/aligning means.

Figure 3:
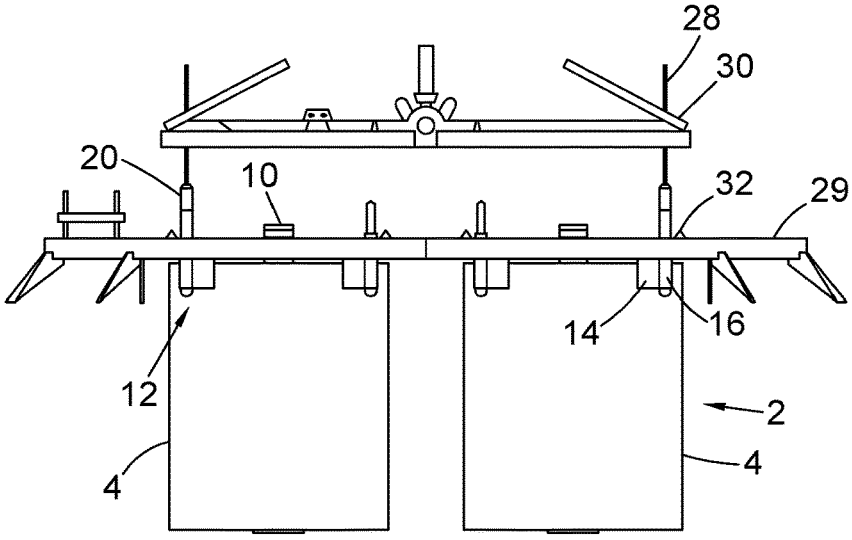
FIG. 3 is a side view of a third subsea well assembly.

FIG. 3 shows a subsea well assembly 1 that comprises two suction anchors 2. The assembly comprises one equipment support structure 29 that extends over both suction anchors 2 and one subsea equipment adapter frame 30 that is supported by both suction anchors 2. Other than the fact that the arrangement comprises two suction anchors 2 rather than one, the assembly is otherwise equivalent to the examples shown in FIGS. 1 and 2.

Figure 4:
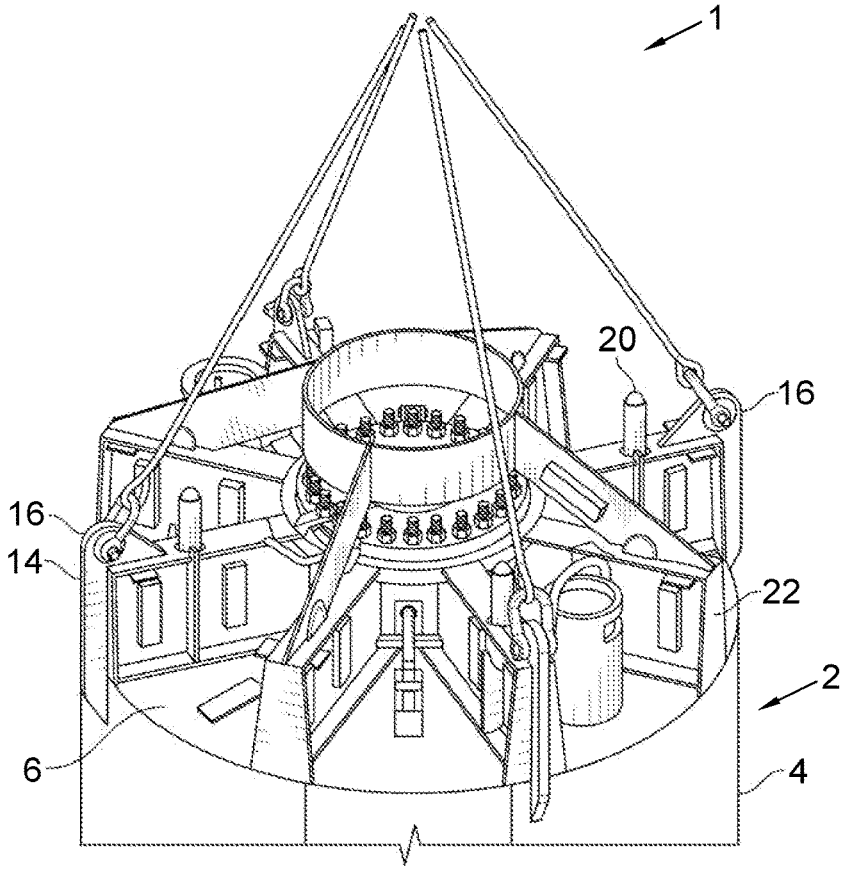
FIG. 4 is a perspective view of a fourth subsea well assembly.

In the assemblies of FIGS. 2 and 3, the wellhead supports cannot be seen as they are located in the internal volume of the suction anchor 1 rather than external to the internal volume on the top plate as in FIG. 1. FIG. 4 shows another subsea well assembly 1. This is broadly equivalent to the assembly 1 shown in FIG. 1 except the well support members 22 are not connected by an outer frame. Also the connection points 12 are mounted on/fixed to/part of the well support members 22. In this figure the connection points 16 are being shown as being used as lift points during installation or uninstallation of the assembly 1. The connection points 12 may be connected to other components such as wellhead load relief during other phases of operation.

Figure 5:
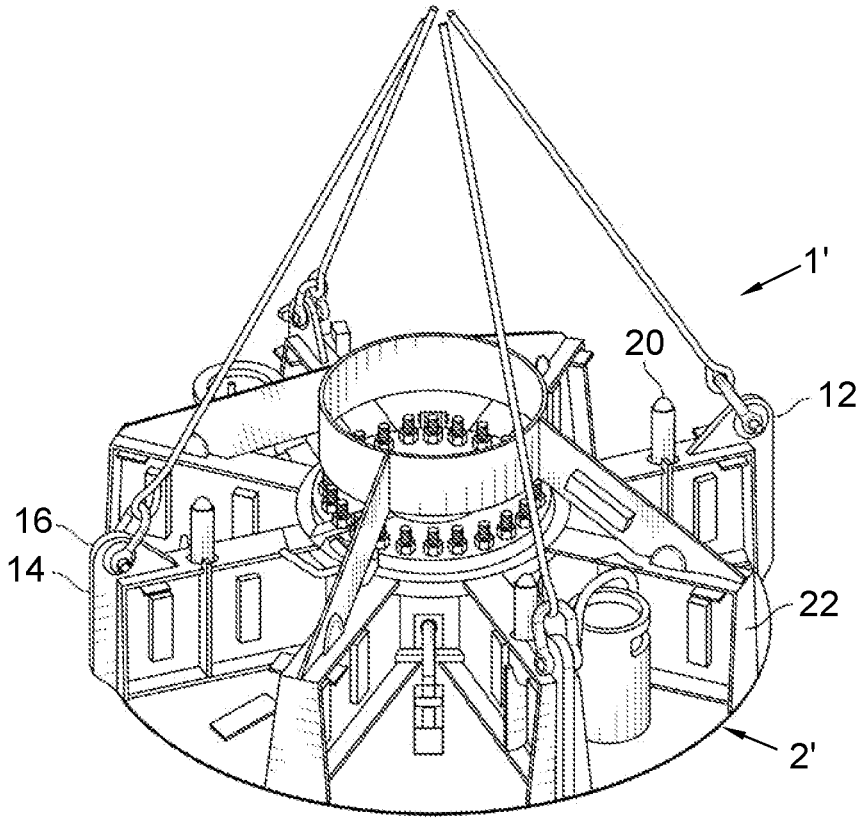
FIG. 5 is a perspective view of a fifth subsea well assembly.
Figure 6:
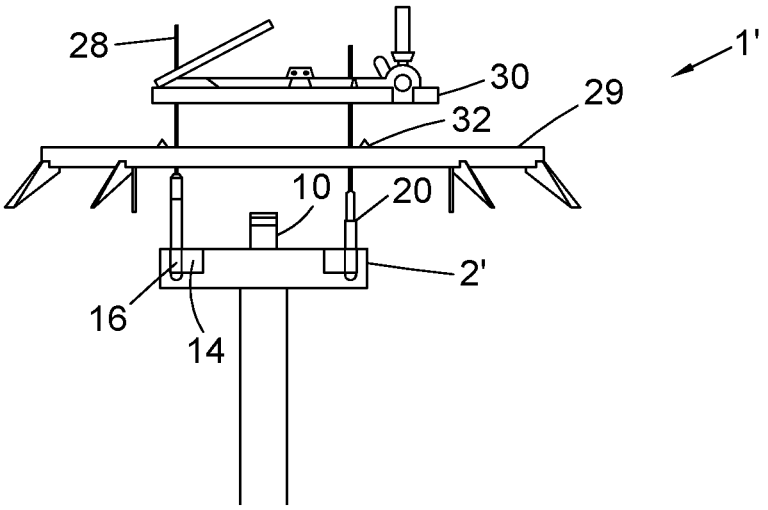
FIG. 6 is a side view of a sixth subsea well assembly.
Figure 7:
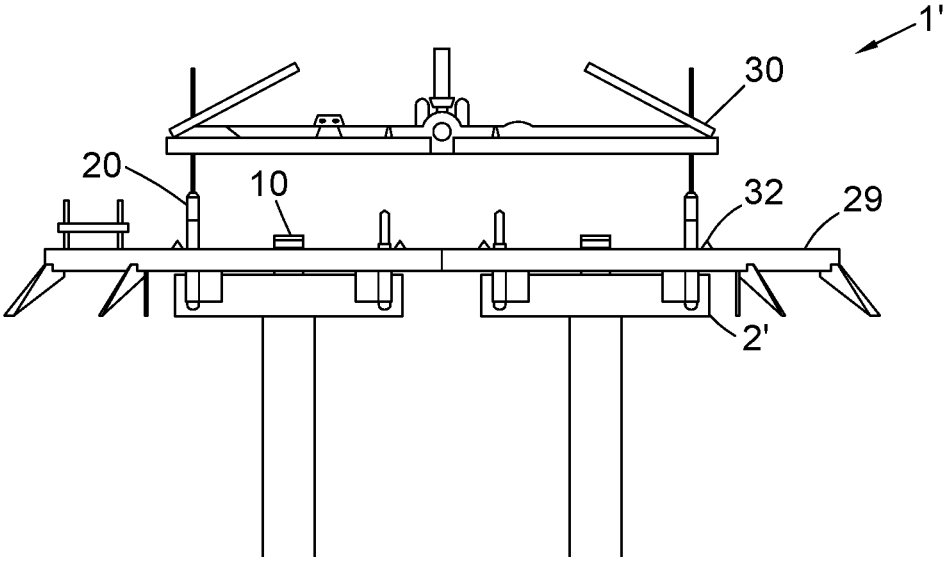
FIG. 7 is a side view of a seventh subsea well assembly.

FIGS. 5, 6 and 7 show assemblies 1' that are equivalent to the assemblies shown in FIGS. 4, 2, 3 respectively, except that the foundation 2' is not a suction anchor 2. In these assemblies 1', the foundation 2' is a plate or slab for example that may be fixed to the seabed by some other means such as cement. As the outer suction skirt 4 of the suction anchor 2 is no longer present, the central tube of the assembly can be seen.

Figure 8:
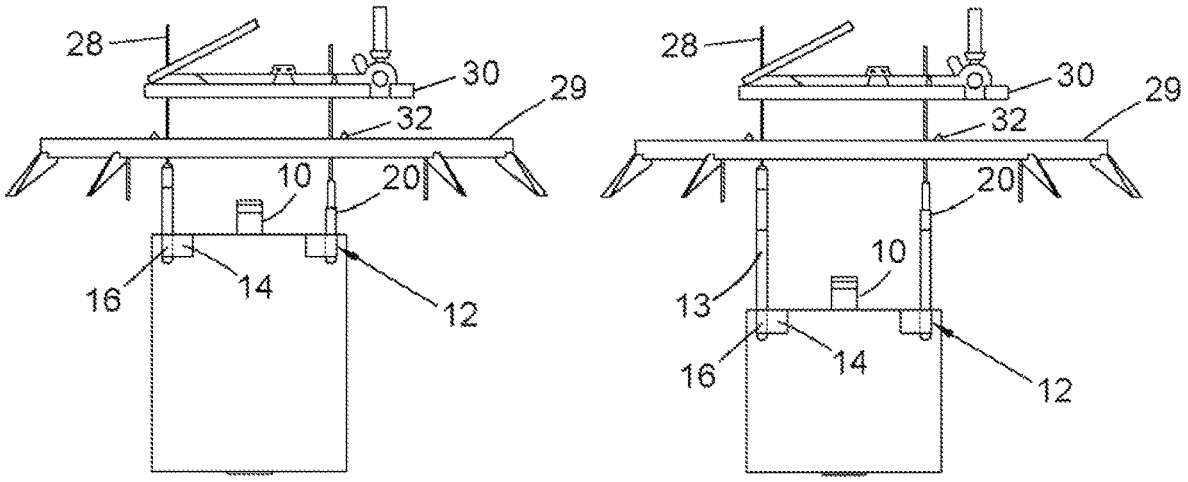
FIG. 8 is a side view of an eighth subsea well assembly.

FIG. 8 shows a subsea well assembly 1 that comprises two suction anchors 2. The two suction anchors 2 have different sizes. The subsea well assembly 1 comprises: (i) a first equipment support structure 29 that extends over a first suction anchor 2 and a first subsea equipment adapter frame 30 that is supported by the first suction anchor 2; and (ii) a second equipment support structure 29 that extends over a second suction anchor 2 and a second subsea equipment adapter frame 30 that is supported by the second suction anchor 2. The connection point 16 of the second suction anchor 2, for example, may be designed to have an adjustable height, i.e. adjustable length. This may be for example achieved by means of one or more adjustable inserts 13. The height of the connection points may be independently adjustable. Independent height adjustment features on individual connection points may permit component position and/or inclination to be adjusted. Other than the fact that the arrangement comprises two differently sized suction anchors 2 wherein the second suction anchor 2 includes adjustable inserts 13, the assembly is otherwise equivalent to the example shown in FIG. 2.

The following clauses set out features of the invention which may not presently be claimed but which may form the basis for amendments or future divisional applications.

The invention claimed is:

1. A system comprising:

a first foundation and a second foundation of different sizes, lengths and/or geometries, wherein:

each of the first foundation and the second foundation comprises connection points;

the connection points of the first foundation are configured to permit first components to be connected to the first foundation and permit first loads to transfer from the first components into the first foundation;

the connection points of the second foundation are configured to permit second components to be connected to the second foundation and permit second loads to transfer from the second components into the second foundation; and the connection points of the first foundation and the connection points of the second foundation are located in the same position relative to each other and/or the connection points of the first foundation and the connection points of the second foundation are the same size, such that the connection points in the first foundation and the connection points in the second foundation are standardized;

the first foundation is part of a first assembly;

the second foundation is part of a second assembly;

the first components are part of the first assembly; and the second components are part of the second assembly.

2. The system according to claim 1, wherein each of the first foundation and the second foundation is a suction anchor.

3. The system according to claim 1, wherein:

the connection points of the first foundation are additional parts that protrude from the first foundation to provide an attachment point for the first components; and the connection points of the second foundation are additional parts that protrude from the second foundation to provide an attachment point for the second components.

4. The system according to claim 1, wherein at least one of the connection points of the first foundation and the connection points of the second foundation has an adjustable height.

5. The system according to claim 1, wherein each of the connection points of the first foundation and the connection points of the second foundation comprises or is arranged to be connected to a guide device.

6. The system according to claim 1, wherein:

the connection points of the first foundation are stronger than adjacent parts of the first foundation; and the connection points of the second foundation are stronger than adjacent parts of the second foundation.

7. The system according to claim 1, wherein:

at least one of the connection points of the first foundation is at an outer perimeter of the first foundation; and at least one of the connection points of the second foundation is at an outer perimeter of the second foundation.

8. The system according to claim 1, wherein:

at least one of the connection points of the first foundation extends beyond a top of the first foundation; and at least one of the connection points of the second foundation extends beyond a top of the second foundation.

9. The system according to claim 1, wherein:

the connection points of the first foundation are at equally spaced locations around an outer perimeter of the first foundation; and the connection points of the second foundation are at equally spaced locations around an outer perimeter of the second foundation.

10. The system according to claim 1, wherein:

the connection points of the first foundation are integral with the first foundation; and the connection points of the second foundation are integral with the second foundation.

11. The system according to claim 1, wherein:

at least one of the connection points of the first foundation has a profile configured to permit the first loads to transfer from one of the first components and/or lock the one of the first components; and at least one of the connection points of the second foundation has a profile configured to permit the second loads to transfer from one of the second components and/or lock the one of the second components.

12. The system according to claim 1, wherein:

each of the connection points of the first foundation comprises a base portion integral with the first foundation and a connection portion to which one of the first components can be attached; and each of the connection points of the second foundation comprises a base portion integral with the second foundation and a connection portion to which one of the second components can be attached.

13. A method comprising providing the system of claim 1.

14. A system comprising:

a first foundation and a second foundation of different sizes, lengths and/or geometries, wherein:

each of the first foundation and the second foundation comprises connection points;

the connection points of the first foundation are configured to permit first components to be connected to the first foundation and permit first loads to transfer from the first components into the first foundation;

the connection points of the second foundation are configured to permit second components to be connected to the second foundation and permit second loads to transfer from the second components into the second foundation;

the connection points of the first foundation and the connection points of the second foundation are located in the same position relative to each other and/or the connection points of the first foundation and the connection points of the second foundation are the same size, such that the connection points in the first foundation and the connection points in the second foundation are standardized;

the first foundation is part of a first assembly; and the second foundation is part of a second assembly, wherein the system further comprises:

at least one first guide device for connection to at least one of the connection points of the first foundation such that one of the first components can be attached to the at least one first guide device, the first loads can be to the first foundation through the at least one guide first device, the one of the first components can be guided toward a correct position and orientation on the first foundation by the at least one first guide device, and/or first guide wires can be attached to the at least one first guide device during an installation procedure; and at least one second guide device for connection to at least one of the connection points of the second foundation such that one of the second components can be attached to the at least one second guide device, the second loads can be to the second foundation through the at least one guide second device, the one of the second components can be guided toward a correct position and orientation on the second foundation by the at least one second guide device, and/or second guide wires can be attached to the at least one second guide device during the installation procedure.

15. The system according to claim 14, wherein:

the at least one first guide device includes a plurality of first guide devices, and one of the plurality of first guide devices protrudes further from the first foundation than another of the plurality of first guide devices; and the at least one second guide device includes a plurality of second guide devices, and one of the plurality of second guide devices protrudes further from the second foundation than another of the plurality of second guide devices.

16. The system according to claim 14, wherein:

the first foundation comprises a first fine alignment device, wherein the at least one first guide device is configured to initially guide the one of the first components toward the correct position and orientation on the first foundation and the first fine alignment device is configured to finally locate the one of the first components and/or lock the one of the first components to the first assembly; and the second foundation comprises a second fine alignment device, wherein the at least one second guide device is configured to initially guide the one of the second components toward the correct position and orientation on the second foundation and the second fine alignment device is configured to finally locate the one of the second components and/or lock the one of the second components to the second assembly.

* * * * *